United States Patent [19]

Kuster

[11] 4,069,585

[45] Jan. 24, 1978

[54] LETTER OPENER

[76] Inventor: Adolf Kuster, Chutzenweg 11, Arch, Switzerland

[21] Appl. No.: 729,915

[22] Filed: Oct. 5, 1976

[30] Foreign Application Priority Data

Nov. 17, 1975 Switzerland ..... 014833/75

[51] Int. Cl.[2] ..... B26B 29/00

[52] U.S. Cl. ..... 30/287; 30/DIG. 3

[58] Field of Search ..... 30/DIG. 3, 280, 289, 30/294, 287

[56] References Cited

U.S. PATENT DOCUMENTS

| | | | |
|---|---|---|---|
| 2,672,933 | 3/1954 | Bridy | 30/DIG. 3 |
| 3,619,902 | 11/1971 | Fleury | 30/294 |

*Primary Examiner*—Jimmy C. Peters

*Attorney, Agent, or Firm*—William A. Drucker

[57] ABSTRACT

A letter opener with a grip-type handle, a blade and a guide slot, wherein a lamellar blade pivots about its inner end and faces downward relative to the guide slot through which it penetrate into a slit aperture along one edge. The blade runs between the legs of a lamellar spring which is bent into a U-configuration and counters the pivot motion of the blade which has at both frontal corners a cutting face with ground edge facing downward relative to the base of the guide slot.

5 Claims, 6 Drawing Figures

LETTER OPENER

The present invention relates to a letter opener comprised of a grip-type handle, a blade and a guide slot.

Whereas various letter openers of this type are prior art, they are expensive to manufacture because they involve a number of components, incorporate screw connexions and/or are of complex design and bulky shape. Moreover, rigidly fastened blades can result in tearing of envelopes manufacture of thin lightweight stock (air mail).

To remedy these disadvantages the same inventor has proposed two letter openers in which the blade is able to recoil against spring pressure.

However, a need became apparent for the blade to be provided with two cutting edges and mounted in such a way as to allow the envelope to be drawn through optionally in either direction while being equally convenient for use by left-handed or right-handed persons.

It is characteristic of the letter opener in this present invention that a lamellar blade pivots about its inner end and faces the guide slot, through which it protrudes into a slit aperture in one edge of the slot, that the blade leads between the legs of a lamellar spring bent into U-configuration and which counteracts the swivel motion of the blade and that the blade has on both corners of its leading edge a cutting face with its ground edge downward relative to the base of the guide slot, so that an envelope can be drawn through the guide slot optionally in either direction whereby the cutting edge draws the edge of the envelope along the bottom of the guide slot.

The drawing depicts an embodiment of the object of invention, as follows.

Figure 1:
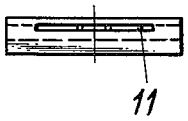
FIG. 1 is a frontal elevation of the letter opener.
Figure 2:
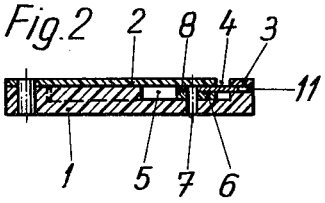
FIG. 2 is a longitudinal section in accordance with FIG. 1 in side elevation.
Figure 3:
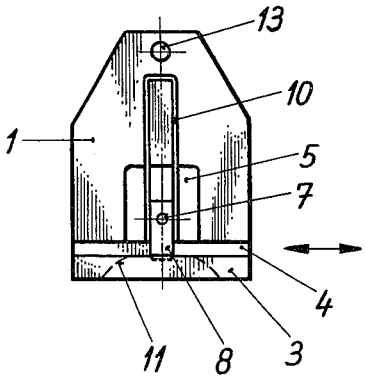
FIG. 3 is a plan elevation re FIG. 1 with upper part lifted off.
Figure 5:
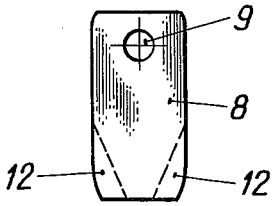
FIG. 5 is a plan elevation re FIG. 4.

The depicted letter opener has a grip-type handle consisting of a lower part 1 and an upper part 2 (FIG.2). The lower part 1 has a lip 3 at its front edge forming a boundary for a guide slot 4 (FIGS. 2, 3). A recess 5 has been made into the side of the guide slot 4 opposite to the outside edge. This recess has a square elevation 6 through which a pin 7 penetrates and protrudes upward. A lamellar, rectangular blade 8 lies on the elevation 6 and is retained in a pivot seating at its inner end by pin 7, which, in turn, protrudes into a hole 9 in blade 8 (FIG. 5).

In the longitudinal direction of the lower part 1 of the grip-type handle and at right angles to guide slot 4 a leaf spring 10 bent into a U-configuration is recessed into the lower part of the handle 1 with its respective ends resting up against the longitudinal sides of the blade 8 and elevation 6 (FIG. 3). The front part of the leaf spring leg is able to recoil sideways into recess 5 and counteracts the reciprocal motion of the blade 8. Lip 3 in lower part 1 is penetrated by a slot aperture 11 into which the leading end of blade 8 protrudes in part.

Figure 4:
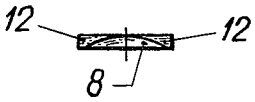
FIG. 4 is a frontal view of the blade in enlarged scale.
Figure 6:
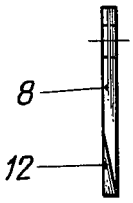
FIG. 6 is a side elevation re FIG. 5.

Each of the two front corners on blade 8 is provided with a cutting edge 12 of which the ground surface is downward relative to the bottom of guide slot 4 (FIGS. 4, 5 & 6), so that cutting edges 12 are at an acute angle relative to the bottom of the guide slot 4. This arrangement ensures that the edge of the envelope is held against the slot base as the envelope is drawn through it.

As blade 8 has two cutting edges, i.e. on the two frontal corners, the envelope can be drawn optionally in either direction through guide slot 4. Provision of two cutting edges ensures a longer service life. This letter opener can be used with equal facility by right-handed and left-handed persons.

The upper part 2 of the grip-handle serves as a cover plate and prevents blade 8 and spring 10 from dropping out. These can be either laid or cast into a slotted recess in lower part 1. A spacer collar can be interposed on pin 7 between blade 8 and upper part 2 to prevent the blade 8 from jamming between spring 10 and upper part 2.

Upper part 2 can be cemented onto lower part 1. These parts can alternatively be held together by two screws, thus permitting either replacement or regrinding of blade 8.

The grip-type handle can either be of a flat square configuration or, as depicted in FIG. 3, display a plan elevation which is rectangular in conjunction with a trapezoidal form. A hole 13 can be provided in the trapezoidal end for suspending device.

The edge of the envelope is cut open by blade 8 on being drawn through slot 4. Thin envelopes, for example in air mail quality, cannot tear when the edge of the envelope comes up against blade 8, as the blade is able to pivot in recoil against the action of the leg of spring 10.

I claim:

1. A letter opener comprising:

i. a handle body having:

a. an elongated guide groove open at both ends, and b. an aperture opening in one side of said guide groove and c. a recess opening into the other side of the guide groove opposite said aperture;

ii. a lamellar blade positioned in and extending from said recess across said guide groove and into said aperture, said blade having at each side of its portion which lies within the guide groove and the aperture, a cutting edge defined by a face lying at an oblique angle with respect to the base of the guide groove thereby to urge towards the base of the guide groove a letter moved along the guide groove into contact with the cutting edge;

iii. means pivotably mounting the lamellar blade to the handle body such that the blade may pivot in both directions along the guide groove, and iv. spring means acting between the handle body and the lamellar blade to urge the blade into a rest position in which it extends across the guide groove.

2. A letter opener, as claimed in claim 1, wherein the handle body comprises a lower portion in which said guide groove and said recess and said aperture are formed, and an upper portion secured on said lower portion and abutting said lamellar blade and said spring means to retain them in the handle body.

3. A letter opener, as claimed in claim 2, wherein said upper and lower portions of handle body are retained releasably together by screws.

4. A letter opener, as claimed in claim 1, comprising spacer means situated in the recess between the handle body and the lamellar blade to space the lamellar blade from the base of the guide groove.

5. A letter opener, as claimed in claim 1, wherein said spring means is a U-shaped blade spring recessed into the handle body and having each of its arms abutting a respective side of the lamellar blade.

* * * * *